US006058896A

United States Patent [19]

Krauth

[11] Patent Number: 6,058,896

[45] Date of Patent: May 9, 2000

[54] VARIABLE VALVE CONTROL FOR AN INTERNAL COMBUSTION ENGINE

[75] Inventor: Dieter Krauth, Waiblingen, Germany

[73] Assignee: DaimlerChrysler AG, Stuttgart, Germany

[21] Appl. No.: 09/280,937

[22] Filed: Mar. 29, 1999

[30] Foreign Application Priority Data

Apr. 2, 1998 [DE] Germany ..... 198 14 800

[51] Int. Cl.[7] ..... F01L 1/34

[52] U.S. Cl. ..... 123/90.17; 123/90.27; 123/90.6

[58] Field of Search ..... 123/90.15, 90.16, 123/90.17, 90.27, 90.31, 90.6

[56] References Cited

U.S. PATENT DOCUMENTS

| | | | |
|---|---|---|---|
| 4,535,733 | 8/1985 | Honda | 123/90.17 |
| 4,546,735 | 10/1985 | O'Neal | 123/90.17 |
| 4,862,845 | 9/1989 | Butterfield et al. | 123/90.15 |
| 5,052,350 | 10/1991 | King | 123/90.16 |
| 5,178,105 | 1/1993 | Norris | 123/90.15 |
| 5,431,132 | 7/1995 | Kreuter et al. | 123/90.16 |
| 5,555,860 | 9/1996 | Wride | 123/90.16 |
| 5,586,527 | 12/1996 | Kreuter | 123/90.15 |
| 5,592,906 | 1/1997 | Kreuter et al. | 123/90.16 |
| 5,931,127 | 8/1999 | Buck et al. | 123/90.17 |

FOREIGN PATENT DOCUMENTS

| | | |
|---|---|---|
| 34 02 605 | 8/1985 | Germany . |
| 43 03 574 | 9/1993 | Germany . |
| 43 22 480 | 1/1995 | Germany . |
| 196 00 536 | 7/1997 | Germany . |

*Primary Examiner*—Weilun Lo
*Attorney, Agent, or Firm*—Klaus J. Bach

[57] ABSTRACT

In a variable valve control for a valve operating mechanism of an internal combustion engine with an inlet-outlet cam shaft for operating the outlet valves and for opening the inlet valves and an inlet valve closing cam shaft whose angular position relative to the inlet-outlet camshaft is adjustable for controlling the inlet valve opening duration, an inlet valve closing cam and an exhaust valve operating cam are disposed essentially in radial alignment and the camshafts are arranged so close together that the top portion circles of the two cams are overlapping but cooperating angularly so that, when the top portions of one of the adjacent cams is directed toward the other cam the top portion of the other cam is directed away from the one cam.

9 Claims, 6 Drawing Sheets

VARIABLE VALVE CONTROL FOR AN INTERNAL COMBUSTION ENGINE

BACKGROUND OF THE INVENTION

The invention relates to a variable valve control for a piston internal combustion engine with at least one inlet valve and at least one outlet valve, an inlet-outlet camshaft including an inlet valve opening cam for controlling the opening time of the inlet valve, an outlet cam for operating the outlet valve, an inlet valve closing camshaft having an inlet valve closing cam for controlling the closing time of the inlet valve, an inlet valve operating lever for transferring the control motion of the inlet valve opening cam and of the inlet valve closing cam to the inlet valve, an outlet valve operating lever for transmitting the control motion of the outlet valve operating cam to the outlet valve and a device for changing the phase relationship between the two camshafts.

Such an arrangement is known, for example, from DE 196 00 536 A1. The arrangement permits the reduction of exhaust gas emissions and also an increase of the engine torque. By reducing the energy needed for the gas exchange the fuel consumption of the engine can also be reduced. Furthermore, there is no need for a throttle valve in the intake duct of the engine.

The arrangement comprises two camshafts, one including an inlet cam for controlling the opening functions of the inlet valve and an exhaust cam for controlling the exhaust valve. The other camshaft includes an inlet valve closing cam for controlling the closing time of the inlet valve. The inlet valve opening and closing cams act in an additive fashion and together determine the opening lift and opening duration of the inlet valve. With a device for changing the phase relation between the two camshafts, the relative angle between the two camshafts can be controlled in order to adjust the opening lift and opening duration of the inlet valve.

The inlet valve opening cam and the inlet valve closing cam are disposed in a common plane so that the rotation of the inlet valve opening cam on the first cam shaft and the rotation of the inlet valve closing cam on the second cam shaft occur in the same plane of movement. Although such a serial arrangement of the inlet cams requires only a small installation space, the exhaust cam, which is arranged on the side of the inlet valve opening cam is displaced axially from the exhaust valve which requires the use of an offset valve opening lever: the contact point between the exhaust cam and the exhaust valve operating lever is disposed outside the center plane of the exhaust valve, that is, outside a plane extending normal to the camshaft and through the exhaust valve axis. This asymmetrical arrangement generates bending forces, which accelerate wear and detrimentally affect precise motion transmission between the cam and the valve.

Furthermore, arrangements for a variable valve control are known which include two inlet valve opening cams and two outlet valve operating cams. The inlet valve opening cam on the one cam shaft is spaced from the inlet valve closing cam on the other cam shaft and the outlet valve operating cams are disposed at axially opposite sides of the inlet valve opening cam. But in this arrangement, the control motion of the exhaust cams must also be transmitted to the exhaust valve by an offset operating lever. In addition, the arrangement of four cams in side-by-side relationship on one camshaft requires a relatively large amount of space so that adjacent cylinders must be relatively widely spaced and the engine becomes relatively long.

It is the principal object of the present invention to provide a variable valve control for an internal combustion engine, which requires relatively little space, but has a high operational reliability.

SUMMARY OF THE INVENTION

In a variable valve control for a valve operating mechanism of an internal combustion engine with an inlet-outlet cam shaft for operating the outlet valves and for opening the inlet valves and an inlet valve closing cam shaft whose angular position relative to the inlet-outlet camshaft is adjustable for controlling the inlet valve opening duration, an inlet valve closing cam and an exhaust valve operating cam are disposed essentially in radial alignment and the camshafts are arranged so close together that the top portion circles of the two cams are overlapping but cooperating angularly so that, when the top portion of one of the adjacent cams is directed toward the other cam the top portion of the other cam is directed away from the one cam.

With this arrangement, the distance between the center planes of inlet valve closing cam and the outlet valve operating cam is only very small, that is, it is smaller then the sum of half the widths of the inlet valve closing cam and the exhaust valve operating cam so that, in an axial view, both cams overlap. Furthermore, the distance between the two cam shafts and the cams are so dimensioned that the high cam portion circles enclosing the cams of the two cam shafts overlap and the high level portions of the inlet valve closing and the exhaust valve operating cams are received in the respective low level portions of the opposite cams without contact.

With this arrangement, the distance between the two cam shafts can be very small while the cam movements of the inlet valve closing cam and of the exhaust valve operating cam do not conflict. As a result, a compact valve operating arrangement of short axial length can be provided since the inlet valve closing cam and the exhaust valve operating cam can be disposed at the same axial location.

Another advantage resides in the fact that, inspite of the short axial length, the individual cams can be sufficiently wide to accommodate the valve operating forces so that a high operational durability and reliability are achieved.

Since the center planes of the exhaust cams and the inlet valve closing cams have only a small distance from each other the member of operating planes for the inlet and exhaust cams is also reduced. In a preferred embodiment, the center planes of the exhaust cam and the operating plane of the exhaust valve essentially coincide so that the operating motion of the exhaust cam is transmitted to the exhaust valve without axial offset and the force transmitting levers are not subjected to twisting torque forces. The exhaust valve operating lever can then be simple since it is straight and extends in a plane normal to the camshaft axis in which also the exhaust valve is disposed.

Preferably, the exhaust valve operating cam is disposed, in an axial projection of the inlet valve opening and outlet valve operating cam within the contour of the inlet valve opening cam. This prevents that the inlet valve opening timing is affected in any way by the outlet valve operating cam.

The arrangement is suitable for internal combustion engines with three valves per cylinder and also for engine with four valves per cylinder.

In three valve engines with two inlet valves and one outlet valve per cylinder, the exhaust valve operating cam is disposed in the middle between two inlet valve opening cams on the inlet-outlet cam shaft. The outlet valve operating cam is disposed in the same center plane with the respective inlet valve closing cam on the other (inlet valve closing) camshaft.

In four valve engines which have two inlet and two outlet valves per cylinder, the two outlet valve operating cams are arranged directly opposite, that is in the same plane with, the respective inlet valve closing cams on the other cam shaft.

Other advantages and suitable embodiments of the invention will become apparent from the following description on the basis of the accompanying drawings.

DESCRIPTION OF PREFERRED EMBODIMENTS

Figure 1:
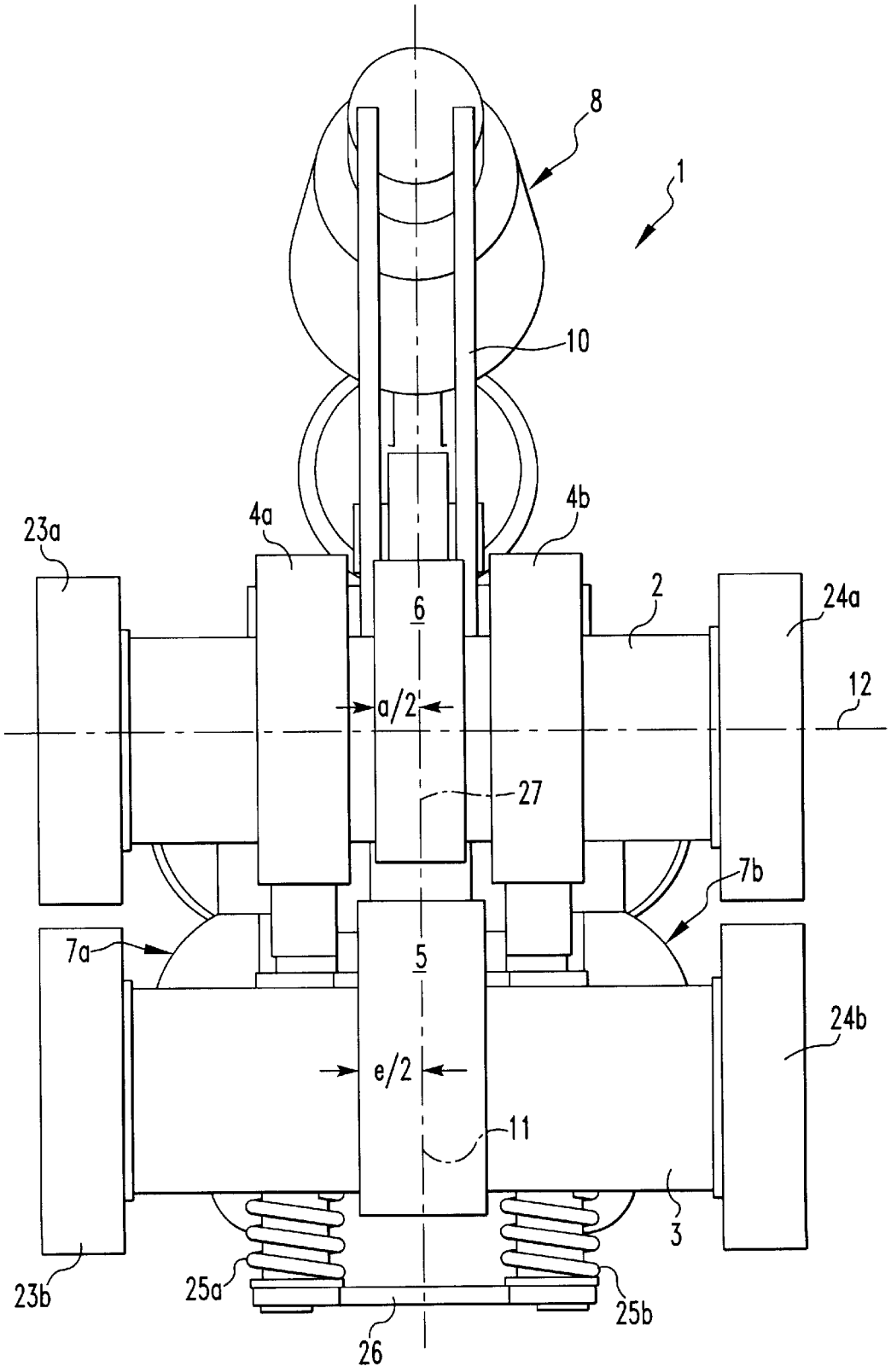
FIG. 1 is a top view of a variable valve control arrangement for an engine with three valves per cylinder.
Figure 2:
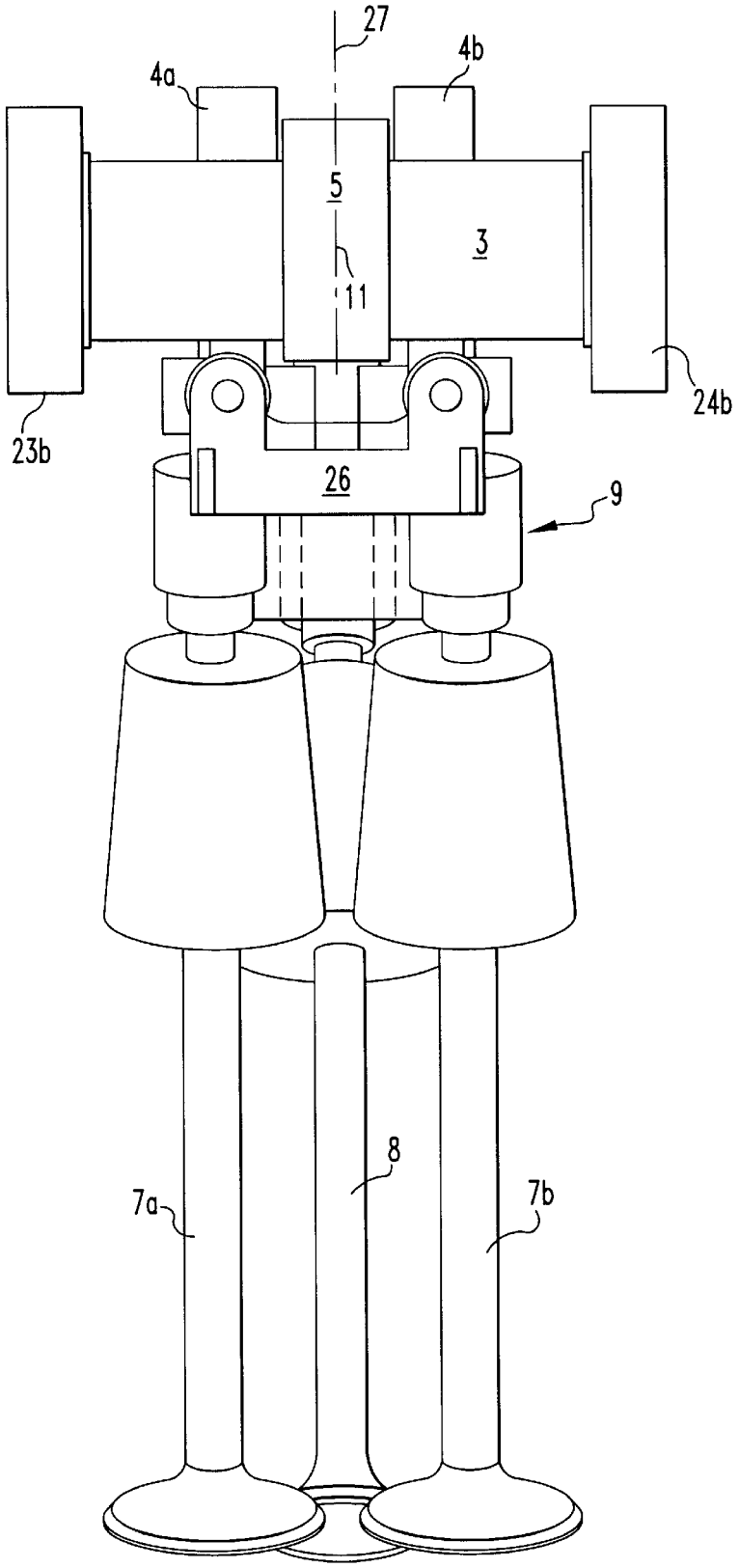
FIG. 2 is a side view of the valve control arrangement.
Figure 3:
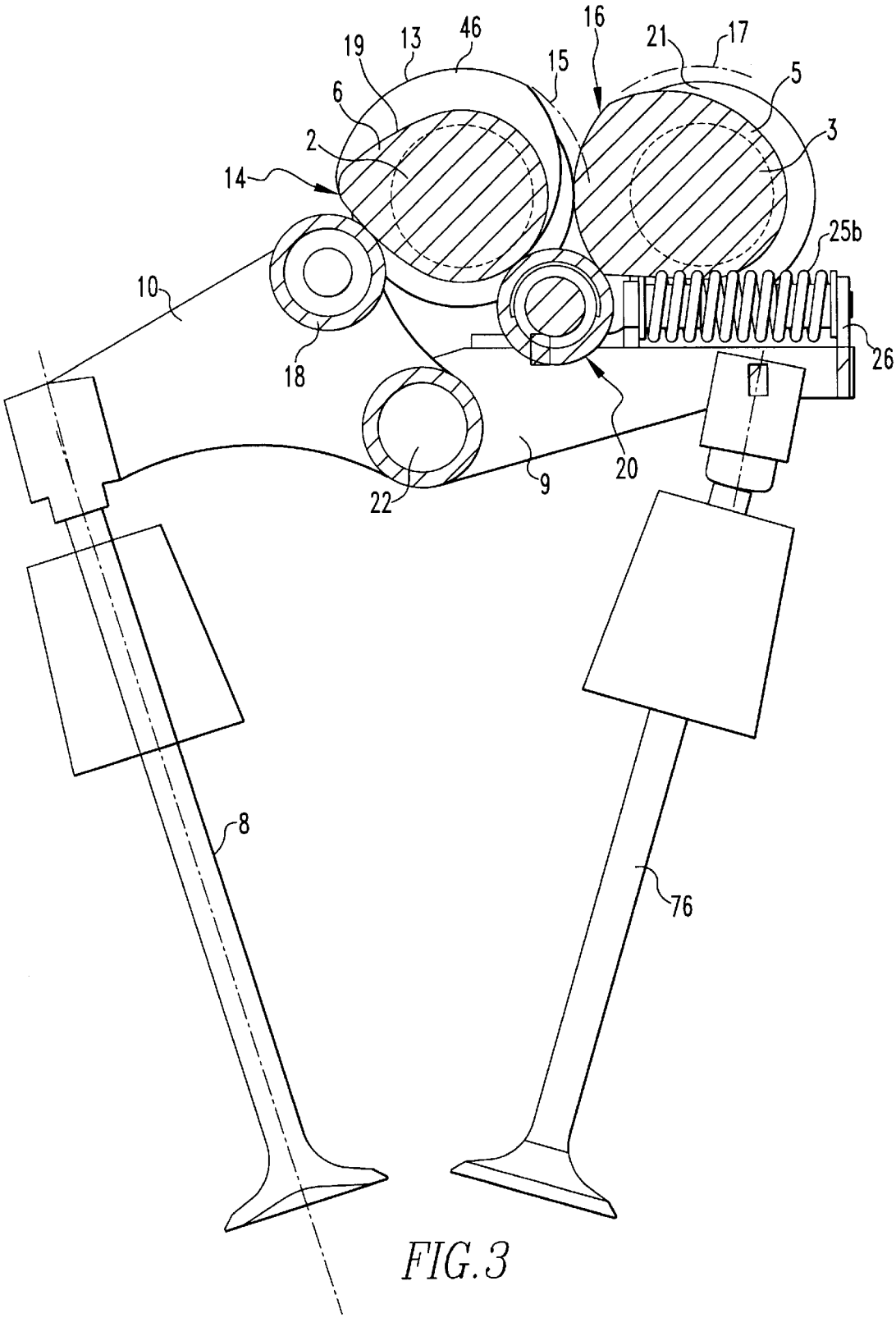
FIG. 3 shows the valve control arrangement in a cross-sectional view.

The variable valve control arrangement 1 as shown in FIGS. 1 to 3 controls the inlet and outlet valves of an internal combustion engine with three valves per cylinder. The arrangement comprises two parallel camshafts, an inlet-outlet camshaft 2 and an inlet valve closing camshaft 3, for controlling the operation of the valves and specifically the inlet valves 7*a*, 7*b*. The inlet-outlet cam shaft 2 also controls the outlet valves 8. By a device not shown herein, particularly a coupler drive, the relative angular positions of the two cam shafts 2, 3 can be changed in order to control the opening duration and the opening lift of the inlet valves 7*a*, 7*b*. With such a valve control arrangement, there is no need for a throttle valve in the intake duct of the internal combustion engine.

The arrangement is described herein for a single cylinder as it is the same for all the cylinders of the engine.

The inlet-outlet camshaft 2 as shown in FIGS. 1–3 includes two inlet valve opening cams 4*a*, 4*b*, which cooperate with an inlet valve closing cam 5 on the parallel inlet valve closing camshaft 3 in an opening time adding procedure. The inlet valve opening cams 4*a*, 4*b* determine the opening movement of the inlet valves while the inlet valve closing cam 5 controls the closing movement of the inlet valves. The control motion of the inlet cams 4*a*, 4*b* 5 is transmitted to the inlet valves 7*a*, 7*b* by an inlet valve actuating lever. The two cam shafts 2, 3 are supported in bearing housings 23*a*, 23*b*, 24*a*, 24*b*.

The inlet-outlet camshaft 2 includes an outlet valve operating cam 6 which is disposed centrally between the two inlet valve opening cams 4*a*, 4*b*. The control motion of the outlet valve operating cam 6 is transmitted to the outlet valve 8 by way of an outlet valve operating lever 10. The center plane 11 of the inlet valve closing cam 5 and the center plane 27 of the outlet valve operating cam 6 coincide or are at least so close together that they are spaced less than the sum of half the width e/2 of the inlet valve closing cam 5 and half the width a/2 of the outlet valve operating cam 6. In the embodiment shown the two center planes 11 and 27 coincide. The cams 5 and 6 rotate in the planes 11, 27 and the movement of the outlet valve 8 also occurs in the plane 11, 27. Also, the motion transfer movement of exhaust valve operating lever occurs in the same plane 11, 27.

As apparent from the cross-sectional view of FIG. 3 in combination with FIG. 1, the contour 19 of the outlet cam 6 in a projection in the direction of the longitudinal axis 12 of the cam shaft 2 is disposed within the contour 13 of the two inlet valve opening cams 4*a*, 4*b*. Also, the high point 14 of the outlet valve operating cam does not extend beyond the contour 13 of the inlet valve opening cams 4*a*, 4*b*.

The high portion circle 15 centered on the axis of the inlet-outlet camshaft 2 and extending through the highest radial portion 14 of the outlet cam 6 intersects the high portion circle 17 centered on the axis of the inlet valve closing cam and extending through the highest radial portion 16 of the inlet valve closing cam. Over a part of its circumference, the high portion circle 17 coincides with the contour 21 of the inlet closing cam 5.

In order to prevent mutual impediment, the two cam high level portions 14 and 16 of the cams 6 and 5 mesh without contacting each other, that is, the high point portions of one cam extends toward the other cam when the low point portion of the other cam is disposed adjacent the one cam for any possible phase adjustment of the camshaft 3 with respect to cam shaft 2.

With the overlapping of the high point portion circles 14, 16, the distance between the two camshafts can be as small as possible so that the whole valve operating mechanism can be small.

As can further be seen from FIG. 3, the control motion of the exhaust valve operating cam 6 is transferred to the operating lever 10 by way of a roller 18, which is mounted on the operating lever 10. The control motion of the inlet valve operating cams is transmitted to the operating lever 9 by way of a roller arrangement 20, which is slidably supported on the inlet valve operating lever 9. The roller structure 20 is biased into contact with the inlet valve opening cams 4*a*, 4*b* two springs 25*a*, 25*b* (FIGS. 1 and 3). The springs 25*a* and 25*b* are supported on a web, which is mounted on the inlet valve operating lever 9.

The inlet valve operating lever 9 and the outlet valve operating lever 10 are pivotally supported on a common lever shaft 22, which extends parallel to the axis of the camshafts 2, 3.

Figure 4:
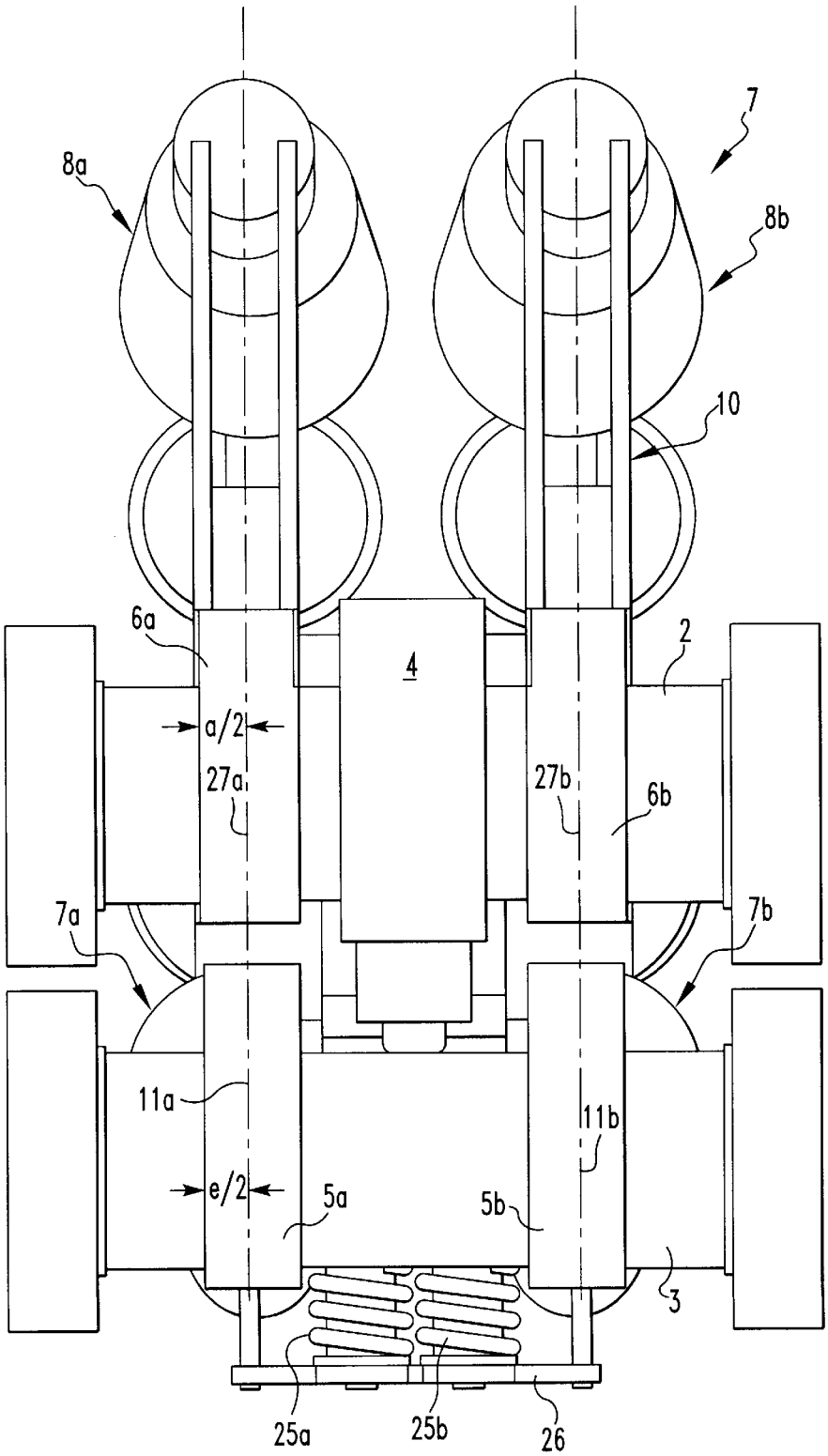
FIGS. 4, 5, and 6 are views corresponding to those of FIGS. 1, 2, and 3 showing a variable valve control arrangement for an engine with four valves per cylinder.
Figure 5:
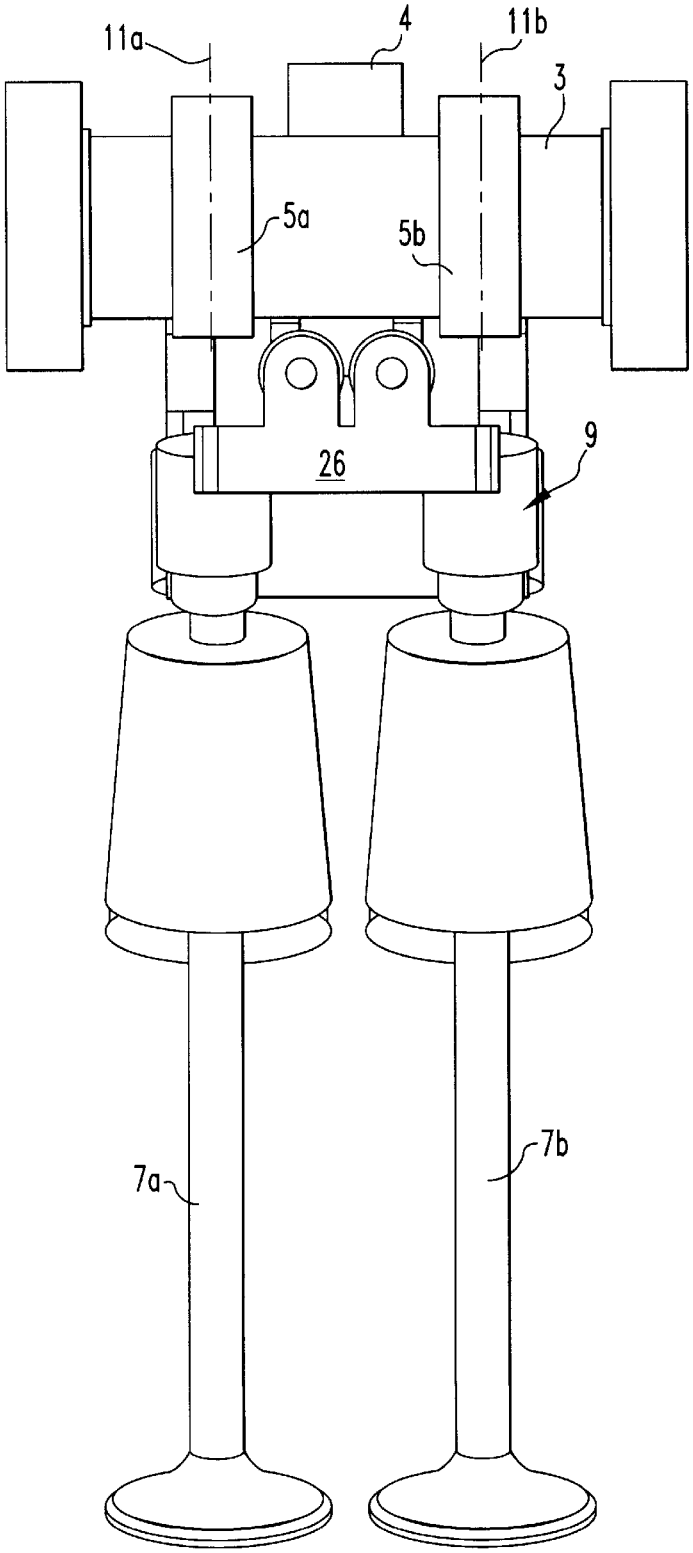
Figure 6:
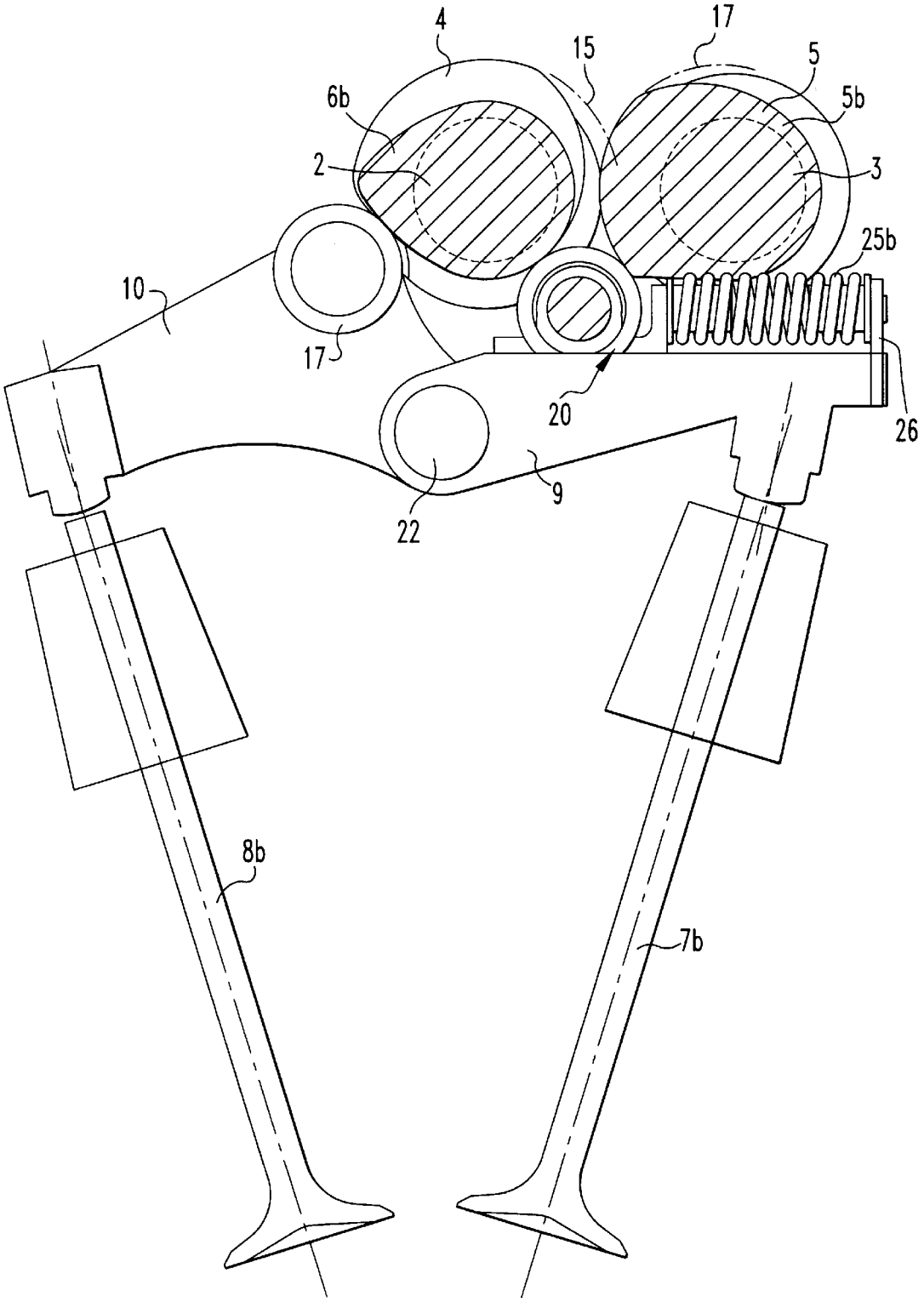

FIGS. 4 to 6 show a variable valve control 1 for an internal combustion engine having four valves per cylinder. The components corresponding to particular components shown in FIGS. 1–3 are provided with the same reference numerals.

Each cylinder of the internal combustion engine includes two inlet valves 7*a*, 7*b* and two outlet valves 8*a*, 8*b*. The inlet and outlet cams for operating the valves are arranged on the two parallel cam shafts 2, 3, whose angular position relative to each other is adjustable by a suitable phase control device.

The inlet-outlet cam shaft 2 includes a central inlet valve opening cam 4, which, together with the axially spaced inlet valve closing cams 5*a*, 5*b* on the inlet valve closing cam shaft 3 controls the inlet valve opening times. The two inlet valve closing cams 5*a*, 5*b* are disposed axially offset from the inlet valve opening cam 4 in the center planes 11*a*, 11*b*. The center planes 27*a*, 27*b* of the exhaust valve operating cams 6*a*, 6*b* and the center planes 11*a*, 11*b* of the inlet valve closing cams 5*a*, 5*b* are disposed closely together such that the distance between the center planes 11*a*, 11*b* and 27*a*, 27*b* is less than the sum of half the width e/2 of the inlet valve closing cam and half the width a/2 of the outlet valve operating cams. Preferably, the planes 11*a* and 27*a* and the planes 11*b* and 27*b* coincide (FIG. 4). The exhaust valve operating cams 6*a* and 6*b* are then arranged in radial alignment with the inlet valve closing cams 5*a* and 5*b*, respectively.

The cam contour of the outlet valve operating cams, that is, the motion of the outlet valve operating lever which is disposed on the same pivot shaft 22 as the inlet valve operating lever 9, is transferred via the rollers 18 mounted on the outlet valve operating levers 10 to the outlet valves 8*a* and 8*b*. The cam contour of the inlet valve operating cams 11*a*, 11*b*, that is, the radial motion of the cams is transferred to the inlet valve operating lever 9 by way of the roller arrangement 20, which is biased into engagement with the inlet valve opening cam 4 by the springs 25*a*, 25*b* supported on the web 26. The motion of the inlet valve operating lever 9 is transferred to the inlet valves 7*a*, 7*b*.

Like in the first embodiment, the cam shafts are arranged so closely together that the cam top portion circle 15 of the exhaust cam 6*a*, 6*b* overlaps the cam top portion circle 17 of the inlet valve closing cams 5*a*, 5*b*, whereby a highly compact valve drive is provided.

What is claimed is:

1. A variable valve control for a valve operating mechanism of an internal combustion engine including at least one inlet valve and at least one outlet valve, an inlet-outlet cam shaft including an inlet valve opening cam for controlling the opening time of the inlet valve and an outlet valve operating cam for operating the outlet valve, an inlet valve closing camshaft whose angular position relative to the inlet-outlet camshaft is adjustable, said inlet valve closing camshaft having an inlet valve closing cam for controlling the closing time of said inlet valve, an inlet valve operating lever pivotally supported adjacent said inlet valve opening cam and said inlet valve closing cam to operate said inlet valve, and an outlet valve operating lever pivotally supported adjacent said outlet valve operating cam for transmitting the control motion of the outlet valve operating cam to said outlet valve, said inlet valve closing cam and said outlet valve operating cam having center planes spaced from each other by a distance which is smaller than the sum of half the width of said outlet valve operating cam and half the width of said inlet valve closing cam, and said outlet valve operating and said inlet valve closing cams having overlapping top portion circles that is circles centered on the respective cam axis and extending through the highest radial portion of the respective cam, said outlet valve operating cam and said inlet valve closing cam being so arranged that the highest radial portions of one of said outlet valve operating cam and said inlet valve closing cam is directed toward the other cam when the highest radial portion of the other cam is directed away from the one cam, and said outlet valve operating cam being dimensioned so that, in an axial projection of the cam shaft, said outlet valve operating cam is disposed within the contour of said inlet valve opening cam.

2. A variable valve control according to claim 1, wherein the center planes of said inlet valve closing cam and said outlet valve operating cam coincide.

3. A variable valve control according to claim 1, wherein said exhaust valve has an axis disposed in the center plane of said exhaust cam.

4. A variable valve control according to claim 1, said outlet valve operating lever includes a roller disposed adjacent the center of said outlet valve operating cam for transferring the radial motion of said outlet valve operating cam to said outlet valve operating lever.

5. A variable valve control according to claim 1, wherein said inlet valve operating lever includes a roller structure slidably supported thereon and spring-biased into engagement with said intake valve opening cam for actuating said inlet valve operating lever via said roller structure.

6. A variable valve control according to claim 1, wherein two inlet valve opening cams are provided for each cylinder which are arranged on said inlet-outlet camshaft at opposite sides of said outlet valve operating cam.

7. A variable valve control according to claim 1, wherein, for each cylinder, two outlet cams are disposed on said inlet-outlet camshaft and two inlet valve closing cams are disposed on said inlet valve closing cam shaft, one of said outlet cams and one of said inlet valve closing cams being disposed in a common central plane.

8. A variable valve control according to claim 7, wherein an inlet valve opening cam is disposed centrally between said two outlet valve operating cams.

9. A variable valve control according to claim 1, wherein said inlet valve operating lever and said outlet valve operating lever are pivotally supported on a common support shaft.

* * * * *